US005149274A

United States Patent [19]

Gallusser et al.

[11] Patent Number: 5,149,274

[45] Date of Patent: Sep. 22, 1992

[54] ELECTRICAL CONNECTOR WITH COMBINED CIRCUITS

[75] Inventors: David O. Gallusser, Oneonta; James B. LeBaron, New York, both of N.Y.

[73] Assignee: Amphenol Corporation, Wallingford, Conn.

[21] Appl. No.: 678,159

[22] Filed: Apr. 1, 1991

[51] Int. Cl.[5] ..... H01R 9/09

[52] U.S. Cl. ..... 439/76; 439/83; 439/589; 439/620

[58] Field of Search ..... 439/76, 83, 581, 589, 439/620

[56] References Cited

U.S. PATENT DOCUMENTS

| | | | |
|---|---|---|---|
| 3,790,858 | 2/1974 | Brancaleone et al. | 317/99 |
| 3,840,841 | 10/1974 | Clark | 439/620 |
| 4,390,221 | 6/1983 | Niles et al. | 439/83 |
| 4,440,463 | 4/1984 | Gliha, Jr. et al. | 339/14 |
| 4,585,284 | 4/1986 | Koser et al. | 339/17 |
| 4,726,638 | 2/1988 | Farrar et al. | 439/620 |
| 4,889,497 | 12/1989 | Riches | 439/76 |
| 4,894,630 | 1/1990 | Ueta et al. | 333/185 |
| 4,954,089 | 9/1990 | Jensen et al. | 439/620 |

FOREIGN PATENT DOCUMENTS 3311410 10/1983 Fed. Rep. of Germany .

*Primary Examiner*—Paula A. Bradley
*Attorney, Agent, or Firm*—Bacon & Thomas

[57] ABSTRACT

A multiple pin connector includes a printed circuit board positioned between insulating components of a connector insert. The printed circuit board electrically connects together contacts of the connector and is affixed to the insulating components by a bonding material. The contacts pass through the insert and are soldered to traces on the circuit board to thereby group circuits at a first end of the connector into fewer circuits at an opposite end of the connector.

18 Claims, 3 Drawing Sheets

ELECTRICAL CONNECTOR WITH COMBINED CIRCUITS

BACKGROUND OF THE INVENTION

1. Field of the Invention

This invention relates to electrical connectors, and more particularly to electrical connector assemblies of the type including a plurality of discrete pin terminals.

2. Description of Related Art

In order to most effectively utilize the data handling capacity of electronic components used in the fields of communications and information processing, it is often more desirable to combine a number of existing components into a system or network rather than to increase the capacity of individual components. Often, however, the individual components were not designed for use in a network, or the network design differs from that contemplated by the designers of the individual components, and thus the individual components of the systems may not be entirely compatible.

The problems of component incompatibility are compounded by the existence, at present, of a relatively large number of different interface standards, which differ not only in communication protocols, but also in the number of input and output (I/O) circuits provided. The solution to this problem has generally entailed adding custom designed adapters to the interfaces, or modifying the interfaces themselves so that the devices to be interconnected at least have the same number of I/O circuits. This greatly increases the complexity of such systems without ultimately solving the problem of compatibility.

Counter to the trend of customizing interfaces, or providing adapters to achieve communication between disparate electrical devices, are recent attempts to incorporate a variety of circuit elements formerly provided in the adapters or interfaces into cable connectors, even while achieving ever greater connector miniaturization. For example, connectors have been proposed which incorporate circuit elements for the purposes of transient suppression, filtering, termination, and the like.

In order to facilitate inclusion of such circuit elements in a miniature connector, it has been proposed to place the circuit elements on circuit boards within the connector. For example, it is known to include within the connector transient suppression diodes or capacitors connected between the contacts and ground via a circuit board. While such circuit boards may appear to electrically interconnect the pins, their function precludes circuit grouping, the traces and circuit elements being arranged to isolate rather than interconnect the pins.

As a result, a satisfactory solution to the problem of grouping I/O circuits or terminals between devices has yet to be achieved. Presently proposed designs are either incompatible with standard multi-pin connector designs or are undesirably complicated. A need clearly exists for a way of grouping together I/O circuits using a design which is compatible with standard connector designs and yet may be easily adapted for a variety of different I/O configurations, and which is reliable and easily manufactured.

SUMMARY OF THE INVENTION

It is an objective of the invention to overcome the drawbacks of the prior art by providing a multiple pin electrical connector for electrically connecting devices having different numbers of input/output circuits which enables the grouping of circuits from the mating end into fewer circuits at the opposite end, which is compatible with standard multiple pin connector designs, and which is nevertheless both reliable and easily manufactured.

These objectives are achieved by providing a multiple pin electrical connector which utilizes a circuit board including conductive traces between holes in the circuit board for directly connecting together two or more contact pins inserted through the holes.

The circuit board of the invention may be easily adapted for a variety of connector designs, including a cylindrical environmentally sealed multiple pin connector, by varying the locations of the traces on the board and/or the size and shape of the board itself.

DETAILED DESCRIPTION OF THE PREFERRED EMBODIMENT

Figure 1:
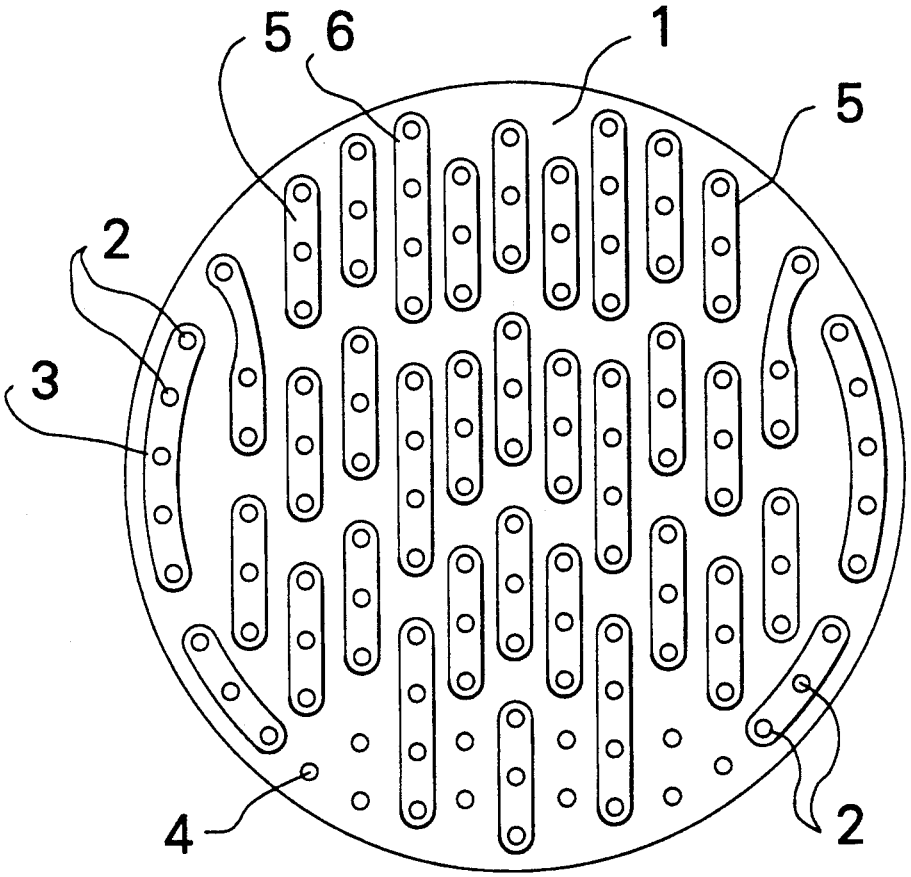
FIG. 1 is a front view of a circuit board according to a preferred embodiment of the invention.

Referring to the figures, the preferred embodiment of the invention includes a circuit board 1 arranged to enable two or more contacts to be electrically connected together and thereby group circuits from the mating end 37 of the connector into fewer circuits at the opposite end 38.

Circuit board 1 is made from an electrically non-conductive material such as plastic or a wood-composite and includes a plurality of holes 2 having a diameter large enough to accommodate insertion of a portion 21 of a standard pin contact formed by contact halves 11 and 13. In the circuit board illustrates in FIG. 1, 128 holes are provided for use with a 128 pin connector, although it will be appreciated that the invention may be modified for use with any number of holes. Also, circuit board 1 is illustrated as being circular for use in a cylindrical connector, but a significant advantage of the invention is that the size and shape of the circuit board may easily be varied depending on the size and shape of the connector in which it is used. 128 pin connectors are commonly used in data processing and communications applications.

In order to accomplish the object of grouping circuits from the mating end 37 to the opposite end 38, circuit board 1 is provided with continuous conductive traces 3, 5, and 6 which interconnect groups of holes 2 and therefore groups of pin contacts. The manner in which these conductive traces are applied to the board is the same as is used in the context of conventional printed circuit boards and may include deposition of the conductive material directly on the board, adhesion of foil made from a conductive material, and so forth. In addition, the conductive areas may be arranged to interconnect any number of holes depending on the requirements of the devices with which the connector will be used. Shown by way of example are traces 3 linking together five holes, trace 5 linking together three holes, and trace 6, linking together four holes. The holes designated by reference numeral 4 in FIG. 1 are not interconnected with any other holes, and the respective pins which pass through holes 4 are therefore not connected to any other pins.

Figure 2:
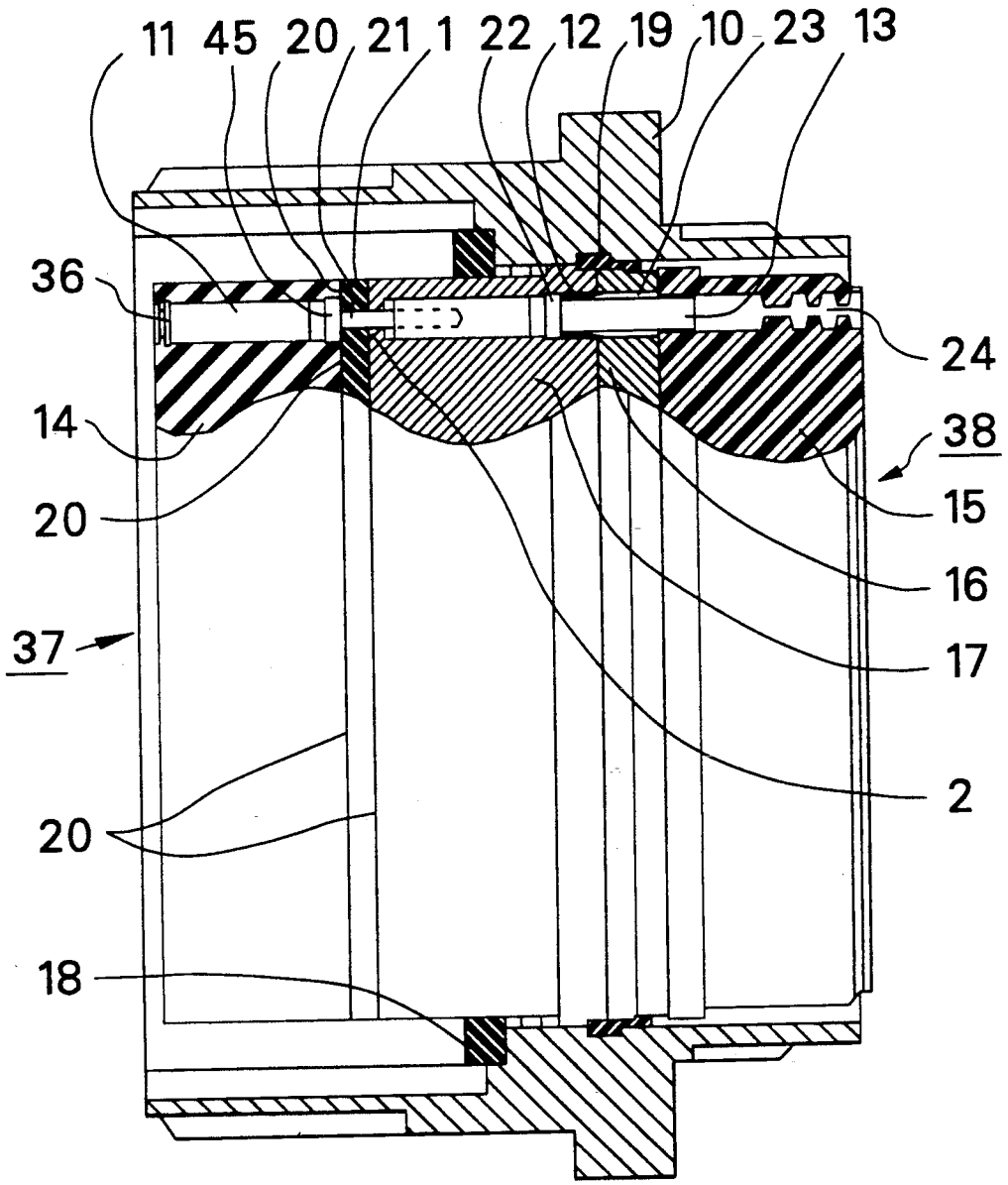
FIG. 2 is a cross-sectional side view showing the manner in which the circuit board of FIG. 1 is used in a connector arranged according to the preferred embodiment of the invention.
Figure 3:
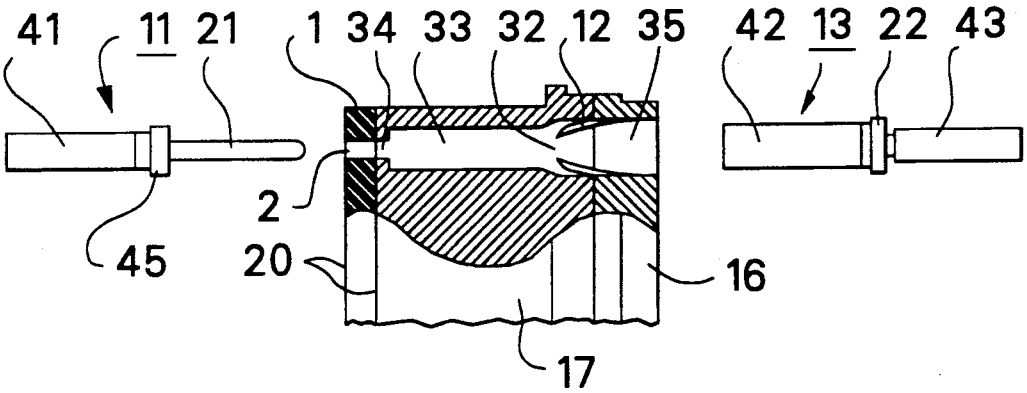
FIG. 3 is a side view similar to that of FIG. 2 showing a connector subassembly, including the circuit board of FIG. 1, prior to installation of the pin contacts.

As is best shown in FIGS. 2 and 3, portion 21 of the contact pin half 11 is inserted through hole 2 from the front or mating end 37 of the connector and is electrically connected to the traces in the circuit board by soldering, for example via solder fillets, although other convenient means of electrical interconnection, including springs on the contact or electrically conductive adhesives may be used.

A complete connector according to the preferred embodiment of the invention shown in FIG. 2 includes a generally cylindrical housing shell 10 which incorpates means for mechanically mating the connector with a corresponding connector. For example, mating end 37 of connector shell 10 may be externally threaded to allow the connector to be mechanically mated to a connector having corresponding internal threads. However, it will be appreciated that the invention is also intended to apply to a variety of other connector shell configurations, including push-in type connectors and those utilizing bayonet or other types of coupling means.

The plurality of pins formed by front pin contacts 11 and rear pin contacts 13, one for each hole in the circuit board, are retained in the connector shell by dielectric inserts 14, 16, and 17, and by a resilient grommet 15 which, in the illustrated embodiment, forms an environmental seal about wires entering the rear of connector.

Dielectric insert 16 includes resilient retaining fingers 12 which engage an annular shoulder 22 on contact 13 as it is pushed into a passage 23 extending through resilient grommet 15 and dielectric members 16 and 17 to thereby secure contact 13 axially with the passage. Passage 23 is formed from three communicating sections of differing diameter. Section 35 in insert 16 has the greatest diameter in order to accommodate retaining fingers 12 and both the front and rear portions 42 and 43 of pin half 13. Section 33 in insert 17 has a smaller diameter to more tightly fit portion 42 of the contact 13 and to prevent entry of shoulder 22. Finally, section 34 communicates with hole 2 in circuit board 1 to permit entry of portion 21 of pin half 11.

Contact 13 is a standard socket contact assembly which is installed and removed from the rear of the connector through dielectric insert 16 and 17, and resilient grommet 15. As is known, a special tool can be used to remove the socket contact assembly by causing fingers 12 to be pressed against the wall of section 32 and therefore disengage shoulder 22 releasing contact 13.

As is best shown in FIG. 3, contact 13 is inserted from the rear of the connector until shoulder 22 engages resilient fingers 12 to secure the contact in a subassembly formed by circuit board 1 and inserts 16 and 17, while portion 21 of front contact 11 is inserted from the front end of the connector through hole 2 in the circuit board and into a bore provided in a front portion 42 of contact 13. Contact 11 may be inserted into insert 14 either before mating of contact 11 with contact 13, or insert 36 may be added after the pin has been assembled.

Circuit board 1 is preferably sandwiched between inserts 14 and 17 and secured by a bonding material or adhesive 20. Inserts 14, 16, and 17, together with circuit board 1 and pin contact halves 11 and 13, then form an integral assembly which may be positioned in connector shell 10 by any convenient means. Bonding material 20 adds strength to the contact mounting means inasmuch as it is allowed, in the preferred embodiment, to flow forward about retaining flange 45 of front contact 11, protecting the circuit board traces and solder joints from over-stress.

It will of course be appreciated that numerous pin contact and contact retaining structures may be substituted for the illustrated structures. For example, it is clearly within the scope of the invention to provide pins which are formed in one-piece, and to support the circuit board along its edges rather than by sandwiching it between dielectric inserts.

In the illustrated embodiment, an insert retainer ring 19 is pressed into place to lock the insert assembly into the shell. The front portion 41 of a contact assembly 11 is designed to mate with a socket contact on a corresponding connector (not shown) inserted from the front end 37 of the connector. Front dielectric insert 14 serves to insulate contacts 11 from one another and provides a mechanical funnel to guide the mating of pin contacts from a mating connector with contacts 11.

Finally, a front gasket 18 is preferably provided to environmentally protect the internal components of the connector when the connector is mated with a corresponding plug connector. The seal is completed by rear grommet 15, including bores 24 having retaining ridges which tightly grip wires (not shown) passing through the gasket to seal the rear of the connector from infiltration of moisture, dust, and other environmental contaminants. The wires may be electrically connected to rear portion 43 of contact 13 by any known method.

It will of course be appreciated by those skilled in the art that the inventive means of grouping circuits together using a connector and printed circuit board will find application in connection with connectors other than the illustrated 128 pin cylindrical connector. While the invention has been described specifically in the context of a particular type of connector, it is intended that the invention not be limited thereto, but rather that it be limited only in accordance with the appended claims.

What is claimed is:

1. A connector for electrically connecting a first electrical component to a second electrical component, comprising:

contact means including a plurality of socket/pin contacts for carrying electrical signals between said first electrical component and said second electrical component;

means for grouping circuits at a first end of said connector into fewer circuits at an opposite end, including a circuit board having a plurality of holes equal in number to the number of said socket/pin contacts, said circuit board having on at least one surface a plurality of continuous conductive traces connecting together at least two, but less than the total number, of said holes in said circuit board, said socket/pin contacts extending through said holes;

means for electrically connecting said socket/pin contacts to said traces;

connector shell means for housing said circuit board and said socket/pin contacts; and means including at least one dielectric insert bonded to said circuit board to form an integral assembly for retaining said circuit board and said socket/pin contacts in said shell means.

2. A connector as claimed in claim 1, further comprising means including an environmental seal positioned between said shell means and said dielectric insert for environmentally sealing interior components of said connector.

3. A connector as claimed in claim 1, wherein said at least one dielectric insert comprises two dielectric inserts which sandwich said board and are secured thereto by an adhesive.

4. A connector as claimed in claim 1, wherein said traces comprise conductive material deposited directly on said circuit board.

5. A connector as claimed in claim 1, wherein said traces comprise conductive foil adhered to said circuit board.

6. A connector as claimed in claim 1, wherein said socket/pin contacts comprise a plurality of mating contact halves, including means permitting coupling of said mating contact halves with corresponding contacts in said first electrical component.

7. A connector as claimed in claim 6, wherein said socket/pin contacts further comprise a plurality of rear contact halves including means for electrically connecting said rear contact halves to wires of an electrical cable.

8. A connector as claimed in claim 1, wherein said socket/pin contacts comprise a plurality of rear contact halves including means for electrically connecting said rear contact halves to wires of an electrical cable.

9. A connector as claimed in claim 8, wherein said at least one dielectric insert comprises two dielectric inserts, each having a plurality of passages extending therethrough at positions corresponding to positions of said holes in said circuit board, said dielectric inserts sandwiching said circuit board, said mating contact halves being positioned in the passages in a first one of said dielectric inserts and including extensions which pass through said holes in said circuit board and engage said rear contact halves which are positioned in passages in a second one of said dielectric inserts.

10. A connector as claimed in claim 9, wherein one of said dielelectric inserts includes resilient retaining means for retaining said socket/pin contacts in said connector.

11. A connector as claimed in claim 9, wherein one of said dielectric inserts are secured to said circuit board by an adhesive.

12. A connector as claimed in claim 11, wherein said rear contact halves each includes an annular shoulder extending therefrom which engages said resilient members to retain said rear contact halves in said connector.

13. A connector as claimed in claim 1, further comprising means including a grommet positioned at said opposite end of said connector for environmentally sealing said connector against infiltration of contaminants through said opposite end of said connector.

14. A connector as claimed in claim 13, wherein said socket/pin contacts comprise a plurality of rear contact halves including means for electrically connecting said rear contact halves to wires of an electrical cable, said wires extending through passages in said grommet.

15. A connector as claimed in claim 1, wherein said shell means is cylindrical and said circuit board is circular.

16. A connector as claimed in claim 15, wherein said plurality of holes consists of 128 holes.

17. A connector as claimed in claim 1, wherein said means for electrically connecting said contact pins to said circuit board comprises solder fillets which form solder joints between said traces and said contacts.

18. A connector as claimed in claim 17, wherein said at least one dielectric insert comprises two dielectric inserts which sandwich said board and are secured thereto by an adhesive which surrounds said solder fillets to protect the solder joints from overstress and also to protect said circuit board traces.

* * * * *